US005967857A

United States Patent [19]

Okabe

[11] Patent Number: 5,967,857

[45] Date of Patent: Oct. 19, 1999

[54] CONNECTOR ASSEMBLY

[75] Inventor: Toshiaki Okabe, Shizuoka, Japan

[73] Assignee: Yazaki Corporation, Tokyo, Japan

[21] Appl. No.: 09/065,602

[22] Filed: Apr. 24, 1998

[30] Foreign Application Priority Data

Apr. 24, 1997 [JP] Japan ..... 9-107644

[51] Int. Cl.[6] ..... H01R 13/502

[52] U.S. Cl. ..... 439/701; 439/542

[58] Field of Search ..... 439/345, 350, 439/540.1, 533, 542, 701

[56] References Cited

U.S. PATENT DOCUMENTS

| | | | |
|---|---|---|---|
| 5,863,223 | 1/1999 | Arnold | 439/701 |
| 5,888,103 | 3/1999 | Norizuki et al. | 439/701 |

FOREIGN PATENT DOCUMENTS

| | | | |
|---|---|---|---|
| 48-578 | 1/1973 | Japan . | |
| 48-579 | 1/1973 | Japan . | |
| 2-115252 | 9/1990 | Japan | H01R 4/02 |
| 4-18980 | 2/1992 | Japan | H01R 13/42 |

*Primary Examiner*—Khiem Nguyen
*Attorney, Agent, or Firm*—Sughrue, Mion, Zinn, Macpeak & Seas, PLLC

[57] ABSTRACT

A connector assembly in which whether or not a plurality of housings have been completely combined together can be easily confirmed without much time and labor, and the plurality of housings can be positively combined together. In the connector assembly, a plurality of housings are stacked and combined together in a multi-stage manner, and each of the housings receives terminals each having a contact portion for connection to a mating terminal and a wire connection portion for connection to an end of a wire, and the housings, combined together, are adapted to be engaged with and fixed to a mounting portion of a vehicle body. The connector assembly further includes a fitting mechanism which allows the engagement and fixing of the connector relative to the mounting portion when the housings are in a completely-combined condition in which the plurality of housings are properly combined together, and prevents the engagement and fixing of the connector relative to the mounting portion when the housings are in an incompletely-combined condition in which the plurality of housings are not properly combined together.

5 Claims, 5 Drawing Sheets

CONNECTOR ASSEMBLY

BACKGROUND OF THE INVENTION

1. Field of the Invention

This invention relates to a connector assembly comprising a plurality of housings stacked and combined together in a multi-stage manner.

2. Background

FIG. 6 shows a connector assembly disclosed in Unexamined Japanese Utility Model Publication No. Sho. 48-578. In this figure, this connector assembly 1 comprises two (lower and upper) housings 2 and 3 stacked and combined together in a two-stage manner. Terminals 5, each connected to an end of a wire 4, are received in each of these housings 2 and 3. Engagement recesses 6 and 6 are formed respectively in opposite side portions of an upper surface of each of the housings 2 and 3, and engagement projections 7 and 7 are formed respectively on opposite side portions of a lower surface thereof.

The two housings 2 and 3 are stacked together in a two-stage manner, and the engagement projections 7 and 7 of the upper housing 3 are engaged respectively in the engagement recesses 6 and 6 of the lower housing 2, so that the housings 2 and 3 are held in a combined condition.

In the above connector assembly 1, however, when the upper and lower housing 3 and 2 are stacked together in a two-stage manner, and are pressed against each other, the engagement projections 7 and 7 sometimes fail to be properly engaged respectively in the engagement recesses 6 and 6, and the connector in an incompletely-engaged condition is transferred to a subsequent step. In this case, when a wire harness, connected to the connector assembly 1, is moved for installation purposes, there is a possibility that the upper and lower housings 3 and 2 are disconnected from each other.

Therefore, it is proposed to confirm whether or not the two housings 2 and 3 for each connector assembly 1 have been properly combined together in a two-stage manner. In this case, however, there is encountered a problem that much time and labor are required for confirming the combined condition.

And besides, when trying to fit the connector in an incomplete condition relative to a mating connector, there is a possibility that the two housings 2 and 3 are disconnected form each other.

SUMMARY OF THE INVENTION

It is therefore an object of this invention to provide a connector assembly in which whether or not a plurality of housings have been completely combined together can be easily confirmed without much time and labor, and the plurality of housings can be positively combined together.

According to the first aspect of the present invention, there is provided a connector assembly which comprises a plurality of housings are stacked and combined together in a multi-stage manner, and each of the housings receives terminals each having a contact portion for connection to a mating terminal and a wire connection portion for connection to an end of a wire, and the housings, combined together, are adapted to be engaged with and fixed to a mounting portion of a vehicle body; and a fitting mechanism which allows the engagement and fixing of the connector relative to the mounting portion when the housings are in a completely-combined condition in which the plurality of housings are properly combined together, and prevents the engagement and fixing of the connector relative to the mounting portion when the housings are in an incompletely-combined condition in which the plurality of housings are improperly combined together.

In this connector assembly, when the plurality of housings are properly combined together, the fitting mechanism allows the engagement and fixing of the connector assembly relative to the mounting portion. Therefore, if the connector assembly can be engaged and fixed relative to the mounting portion, it is easily confirmed from this that the plurality of housings have been completely combined together.

If the plurality of housings are not properly combined together, the engagement and fixing of the connector assembly relative to the mounting portion is prevented. Therefore, if the connector assembly cannot be engaged and fixed relative to the mounting portion, it is easily confirmed from this that the plurality of housings have not been completely combined together.

According to the second aspect of the present invention, the housings include an upper-stage housing and a lower-stage housing, the fitting mechanism includes a passage groove which is formed in the upper-stage housing for passing a plate-like lock piece portion of the mounting portion therethrough, and an insertion groove which is formed in the lower-stage housing, and receives the lock piece portion, passed through the passage groove, in the completely-combined condition, and fails to receive the lock piece portion, passed through the passage groove, in the incompletely-combined condition.

In this connector assembly, if the upper-stage housing and the lower-stage housing are properly combined together, the lock piece portion of the mounting portion, passed through the passage groove, is inserted into the insertion groove. Therefore, if the lock piece portion, passed through the passage groove, is inserted into the insertion groove, it is easily confirmed from this that the upper-stage and lower-stage housings have been properly combined together.

If the upper-stage housing and the lower-stage housing are not properly combined together, the lock piece portion, passed through the passage groove, cannot be inserted into the insertion groove. Therefore, if the lock piece portion, passed through the passage groove, cannot be inserted into the insertion groove, it is easily confirmed from this that the upper-stage and lower-stage housings have not been properly combined together.

According to the third aspect of the present invention, the housings include a body, and terminal receiving grooves for respectively receiving the terminals, and the upper-stage housing includes a cover for opening and closing the terminal receiving grooves, and a hood wall formed integrally at that portion of the housing opposite to the terminal receiving grooves, and the lower-stage housing includes a hood wall which is formed integrally at that portion of the housing opposite to the terminal receiving grooves, and covers the contact portions of the terminals, and the passage groove is formed in the body of the upper-stage housing, and the insertion groove is formed in the hood wall of the lower-stage housing, and when the plurality of housings are completely combined together, the passage groove and the insertion groove jointly form an engagement groove in which the lock piece portion can be inserted and engaged.

In this connector assembly, the upper-stage housing, in which the terminal receiving grooves, respectively receiving the terminals, are closed by the cover, and the lower-stage housing having the terminals received respectively in the terminal receiving grooves, are stacked and combined together in a two-stage manner. At this time, the contact portions of the terminals project into the interior of the hood walls. The lock piece portion is passed through the passage groove in the upper-stage housing, and is inserted into the insertion groove in the lower-stage housing. At this time, if the lock piece portion, passed through the passage groove, cannot be inserted into the insertion groove, it can be easily conformed form this that the upper-stage housing and the lower-stage housing are not properly combined together. If the lock piece portion, passed through the passage groove, can be inserted into the insertion groove, it can be easily confirmed from this that the upper-stage housing and the lower-stage housing are properly combined together.

According to the fourth aspect of the present invention, when the plurality of housings are completely combined together, the upper-stage housing closes the terminal receiving grooves in the lower-stage housing, and the two hood walls are completely combined together to form a hood portion for receiving a mating connector.

In this connector assembly, when the upper-stage housing and the lower-stage housing are completely combined together, the upper-stage housing closes the terminal receiving grooves in the lower-stage housing, and the two hood walls are combined together to form the hood portion for receiving the mating connector.

According to the fifth aspect of the present invention, the terminal is a press-connecting terminal having a press-connecting portion formed at the wire connection portion, and the press-connecting portion has a pair of press-connecting blades between which the wire end is press-connected.

In this connector assembly, by press-fitting the wire end into the wire connection portion of the terminal received in the wire receiving groove, the wire end is inserted in between the press-connecting blades, thereby making a connection between the wire and the terminal.

DETAILED DESCRIPTION OF THE PREFERRED EMBODIMENT

A preferred embodiment of a connector assembly of the present invention will now be described.

Figure 1:
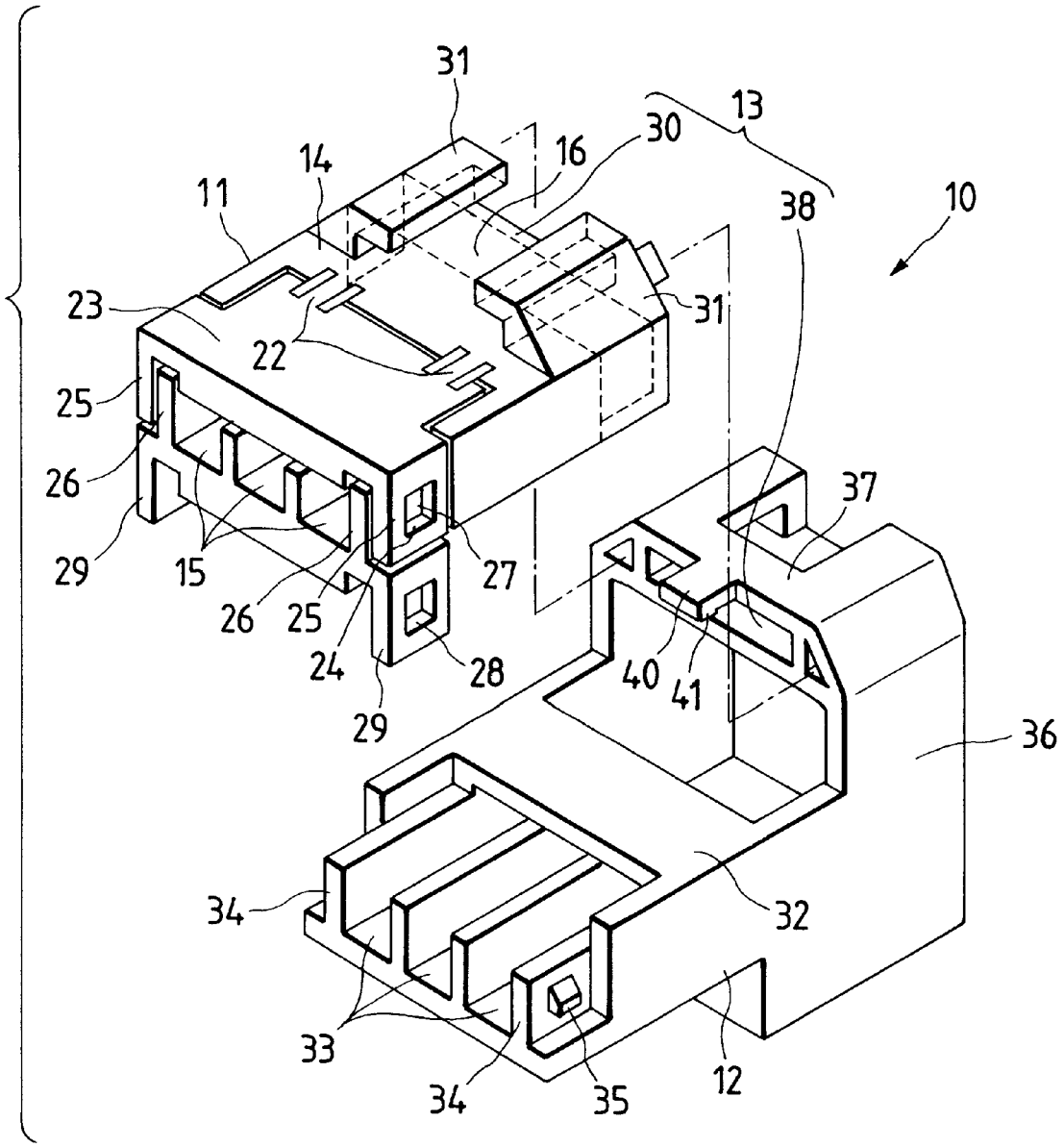
FIG. 1 is an exploded, perspective view of a preferred embodiment of a connector assembly of the invention.
Figure 2:
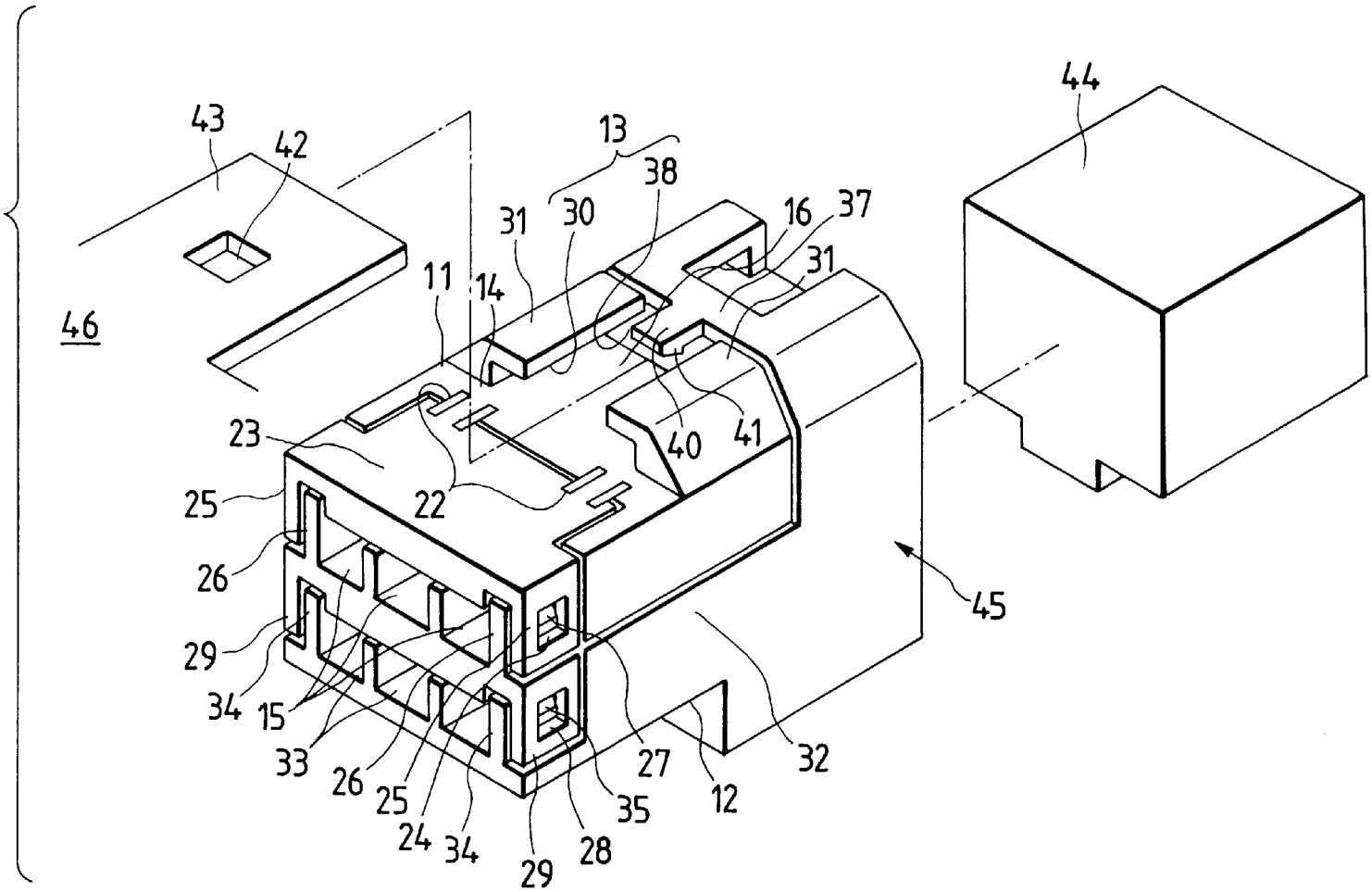
FIG. 2 is a perspective view showing the connector assembly of this embodiment.
Figure 3:
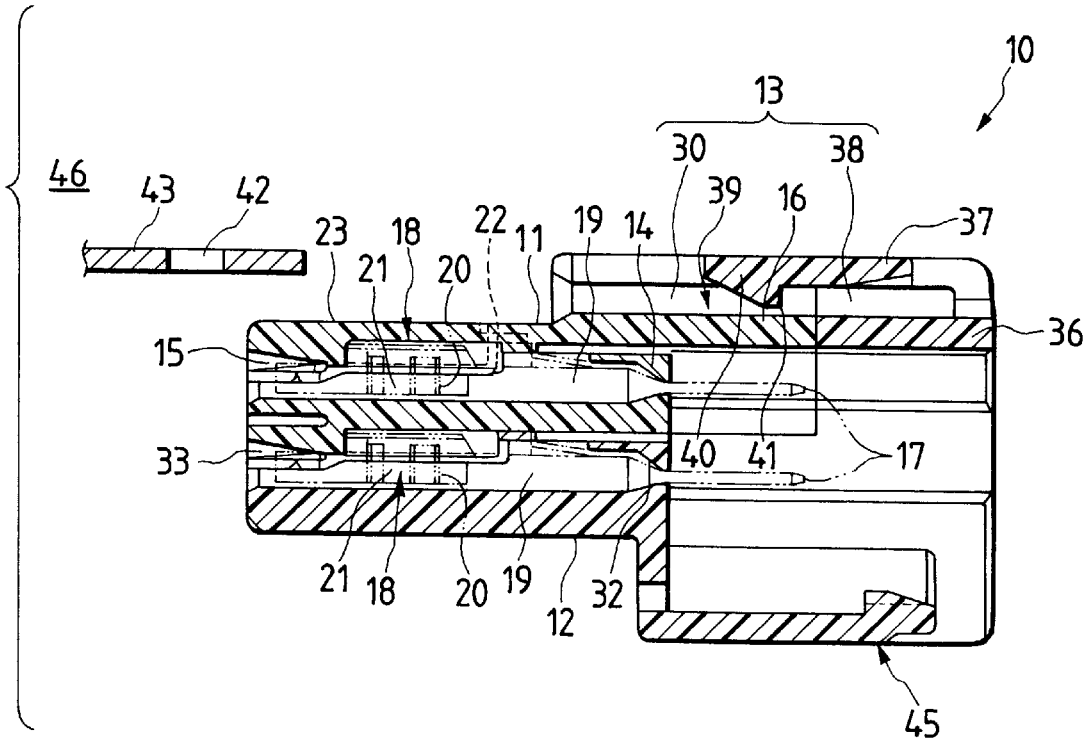
FIG. 3 is a cross-sectional view showing the interior of the connector assembly of this embodiment.

As shown in FIGS. 1 to 3, a connector assembly 10 includes an upper housing 11 and a lower housing 12 stacked and combined together in a two-stage manner. The connector assembly 10, having the upper housing 11 and the lower housing 12 combined together, is adapted to be engaged with and fixed to a mounting portion of a vehicle body. The connector assembly 10 has a fitting mechanism 13 which allows the engagement and fixing of the connector assembly 10 relative to the mounting portion when the connector assembly 10 is in a completely-combined condition in which the two housings 11 and 12 are properly combined together, and prevents the engagement and fixing of the connector relative to the mounting portion when the connector assembly 10 is in an incompletely-combined condition in which the two housings 11 and 12 are not properly combined together.

The upper housing 11, which is to be disposed at an upper position in the combined condition of the connector, has a plurality of terminal receiving grooves 15 formed in one side portion of a body 14, and also has a hood wall 16 projected at the other side portion. A terminal 19 is inserted and received in each of the terminal receiving grooves 15, and the terminal 19 has a contact portion 17 for connection to a mating terminal, and a wire connection portion 18 connected to an end of a wire. The terminal 19 has a press-connecting portion 21 formed at the wire connection portion 18, and the press-connecting portion 21 has a pair of press-connecting blades 20 between which the wire end is to be press-fitted.

A cover 23 for opening and closing the terminal receiving grooves 15 is provided at that side of the hood wall 16 disposed close to the terminal receiving grooves 15. This cover 23 is molded integrally with the body 14 through hinges 22. Retaining frame portions 25 and 25 each having a retaining hole 24 are formed respectively at opposite sides of a distal end of the cover 23. Retaining projections 27 and 27, formed respectively on widthwise opposite side walls 26 and 26 of the terminal receiving grooves 15, are inserted and engaged in the retaining holes 24 and 24, respectively.

Retaining frame portions 29 and 29 each having a retaining hole 28 are formed on and project from the opposite sides of the terminal receiving grooves 15 in the body 14, respectively. As shown in FIG. 2, a passage groove 30, through which a plate-like lock piece portion 43 of the mounting portion of the vehicle body can passed, is provided at the upper surface of the hood wall 16. This passage groove 30 is formed between a pair of guide walls 31 and 31 formed respectively on opposite side portions of the upper surface of the hood wall 16.

The lower housing 12, which is to be disposed at a lower position in the combined condition of the connector, has a plurality of terminal receiving grooves 33 formed in one side portion of a body 32, and also has a hood wall 36 of a rectangular cross-section projected at the other side portion. Retaining projections 35 and 35 are formed respectively on widthwise opposite side walls 34 and 34 of the terminal receiving grooves 33. When the upper and lower housings 11 and 12 are stacked together, the retaining projections 35 and 35 are inserted and engaged respectively in the retaining holes 28 and 28 in the upper housing 11.

A lock plate portion 37 is formed on an upper surface of the hood wall 36, and an insertion groove 38 is formed between the lock plate portion 37 and the upper surface of the hood wall 36. In the completely-combined condition in which the upper and lower housings 11 and 12 are properly combined together, the insertion groove 38 communicates with the passage groove 30 of the upper housing 11 to thereby form one engagement groove 39 (see FIG. 3). In this case, in the incompletely-combined condition in which the upper and lower housings 11 and 12 are not properly combined together, the passage groove 30 and the insertion groove 38 do not communicate with each other, and therefore one engagement groove 39 is not formed.

A lock arm 40 projects from an end edge of the lock plate portion 37 toward the terminal receiving grooves 33. A downwardly-directed retaining projection 41 is formed at a distal end portion of the lock arm 40. This retaining projection 41 is inserted and engaged in a retaining hole 42 formed in the distal end portion of the plate-like lock piece portion 43 of the mounting portion 46 of the vehicle body.

The fitting mechanism 13 includes the passage groove 30, formed in the upper housing 11, and the insertion groove 38 formed in the lower housing 12.

Next, a method of assembling the connector assembly 10, as well as the procedure of mounting the connector on the vehicle body, will be described.

Figure 4:
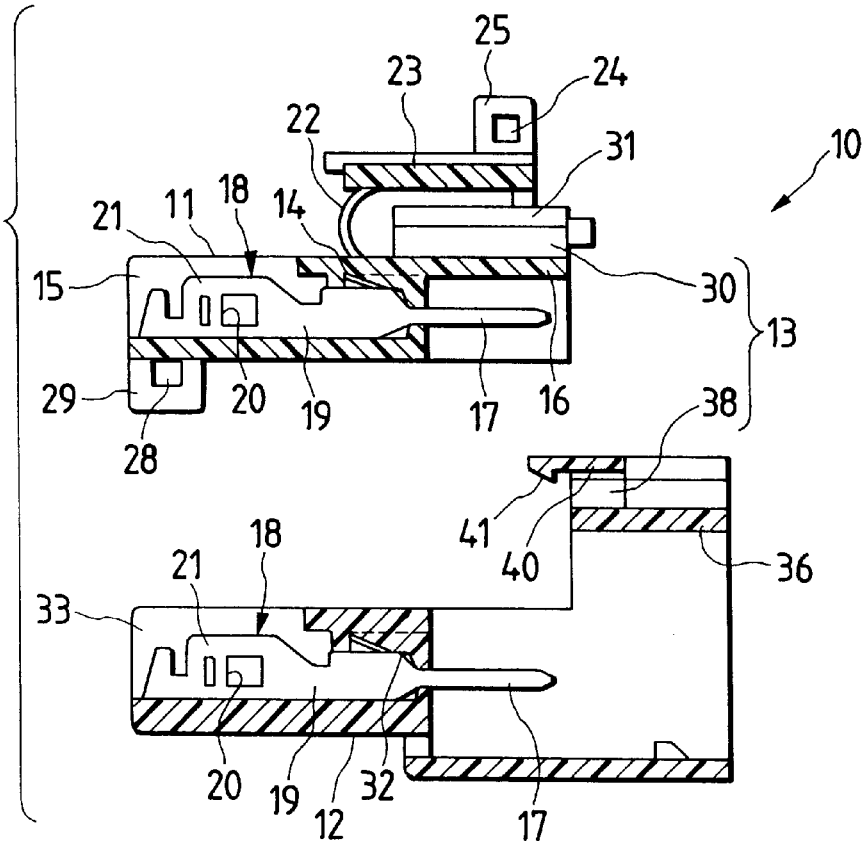
FIG. 4 is an exploded, cross-sectional view showing the interior of the connector assembly of this embodiment.

As shown in FIG. 4, the two housings 11 and 12 are disconnected from each other, and in this condition the terminals 19 are inserted respectively into the terminal receiving grooves 15, 33 of each of the housings 11 and 12, and the wire end is press-fitted into the wire connection portion 18 of each terminal, thereby connecting the wire and the terminal 19 together (In FIG. 1, the wires are not shown). The upper sides of the terminal receiving grooves 15 in the upper housing 11 are closed by the cover 23. At this time, the retaining projections 27 are inserted and engaged in the retaining holes 24, respectively. In this condition, the upper housing 11 is placed on the lower housing 12, and the two are combined together as shown in FIGS. 2 and 3.

At this time, the upper sides of the terminal receiving grooves 33 in the lower housing 12 are covered by the upper housing 11, and the retaining projections 35 and 35 of the lower housing 12 are inserted and engaged respectively in the retaining holes 28 and 28 in the upper housing 11. At the same time, the hood wall 16 of the upper housing 11 is combined with the hood wall 36 of the lower housing 12, thereby forming a hood portion 45 for receiving a mating connector 44 (see FIG. 2).

In this condition, the contact portions 17 of the terminals 19, received respectively in the terminal receiving grooves 15 in the upper housing 11, and the contact portions 17 of the terminals 19, received respectively in the terminal receiving grooves 33 in the lower housing 12, project into the interior of the hood portion 45. When the upper housing 11 and the lower housing 12 are properly combined together, the passage groove 30 and the insertion groove 38 jointly form one engagement groove 39.

Then, in this condition in which the upper and lower housings 11 and 12 are combined together, the lock piece portion 43 of the mounting portion is passed through the passage groove 30 in the upper housing 11, as shown in FIG. 2. Subsequently, the lock piece portion 43, passed through the passage groove 30, is inserted into the insertion groove 38.

At this time, in the completely-combined condition in which the upper and lower housings 11 and 12 are properly combined together, the passage groove 30 and the insertion groove 38 communicate with each other to form one engagement groove 39, and the lock piece portion 43 can be inserted into the insertion groove 38. Since the lock piece portion 43, passed through the passage groove 30, can be thus inserted into the insertion groove 38, it can be confirmed that the housings 11 and 12 are completely combined together.

Figure 5:
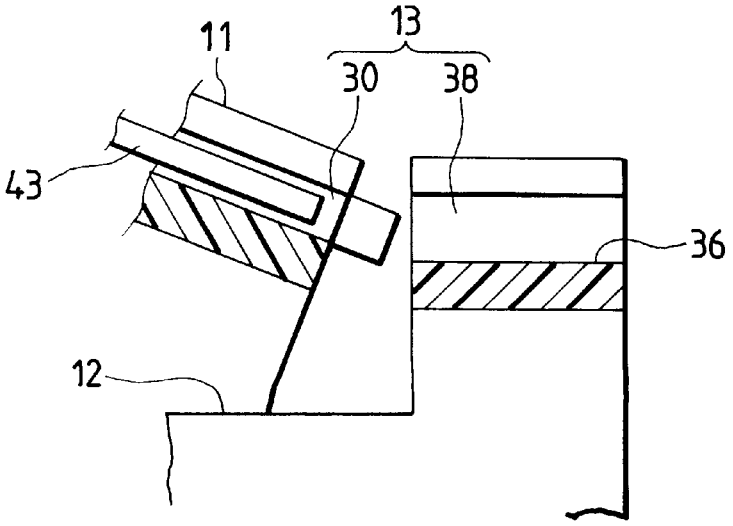
FIG. 5 is an enlarged, cross-sectional view showing a passage groove and an insertion groove which jointly form fitting mechanism.
Figure 6:
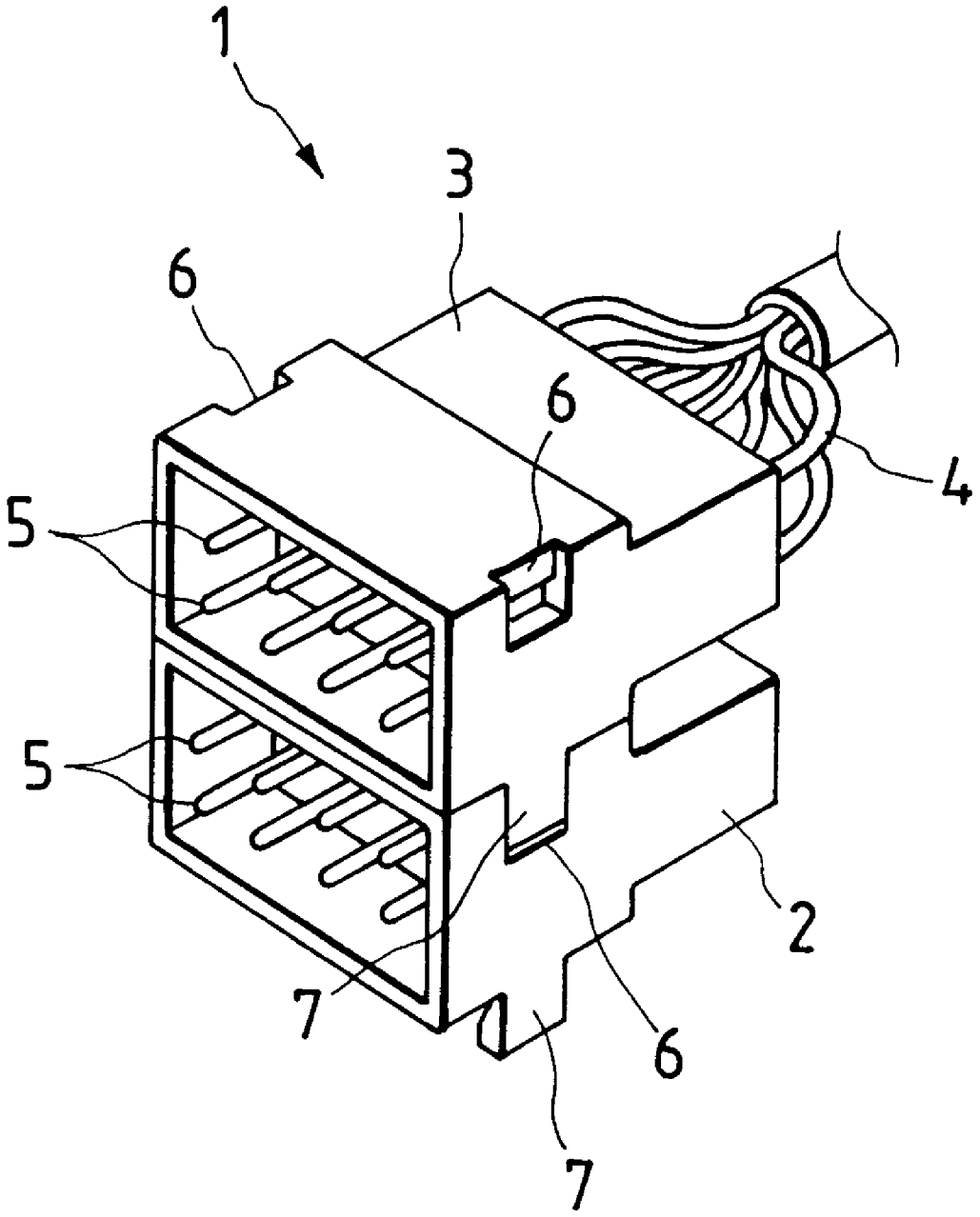
FIG. 6 PRIOR ART
FIG. 6 is a perspective view of a conventional connector assembly.

In the incompletely-combined condition in which the upper and lower housings 11 and 12 are not properly combined together, the passage groove 30 and the insertion groove 38 cannot form one engagement groove 39, as shown in FIG. 5. Therefore, the lock piece portion 43, passed through the passage groove 30, cannot be inserted into the insertion groove 38. Thus, Since the lock piece portion 43, passed through the passage groove 30, cannot be inserted into the insertion groove 38, it can be confirmed that the housings 11 and 12 are incompletely combined together. In this case, the upper and lower housings 11 and 12 are again combined together, and by doing so, the housings 11 and 12 can be combined together into the completely-combined condition.

In this embodiment, whether or not the housings 11 and 12 are completely combined together can be confirmed by judging whether or not the lock piece portion 43 of the mounting portion of the vehicle body can be inserted into the insertion groove 38, and therefore whether or not the two housings 11 and 12 have been completely combined together can be easily confirmed without much time and labor.

The combined condition of the two housings 11 and 12 can be easily confirmed, and therefore even if they are in the incompletely-combined condition, this can be easily confirmed, and can be corrected, and therefore the housings 11 and 12 can positively be properly combined together.

In this embodiment, the lock piece portion 43 is passed through the passage groove 30, and is inserted into the insertion groove 38, and the retaining projection 41 is engaged in the retaining hole 42, and in this condition the lock piece portion 43 serves as a reinforcement member, thereby increasing the strength of the hood portion 45.

In this embodiment, the hood portion 45 includes the combination of the hood wall 16 of the upper housing 11 and the hood wall 36 of the lower housing 12, and in this case the hood wall 36 of the lower housing 12 is formed into a rectangular cross-section, and therefore even when the mating connector is forcibly fitted into the connector, a force acts only on the hood wall 36 of the lower housing 12, and the strength of combination will not be affected.

As described above, when the plurality of housings are properly combined together, the fitting mechanism allows the engagement and fixing of the connector assembly relative to the mounting portion, and therefore, it is easily confirmed from this that the plurality of housings have been completely combined together.

If the plurality of housings are not properly combined together, the engagement and fixing of the connector assembly relative to the mounting portion is prevented, and therefore it is easily confirmed from this that the plurality of housings have not been completely combined together.

In the invention, if the upper-stage housing and the lower-stage housing are properly combined together, the lock piece portion of the mounting portion, is passed through the passage groove, and is inserted into the insertion groove. Therefore, if the lock piece portion, passed through the passage groove, is inserted into the insertion groove, it is easily confirmed from this that the upper-stage and lower-stage housings have been properly combined together.

If the upper-stage housing and the lower-stage housing are not properly combined together, the lock piece portion, passed through the passage groove, cannot be inserted into the insertion groove. Therefore, if the lock piece portion, passed through the passage groove, cannot be inserted into the insertion groove, it is easily confirmed from this that the upper-stage and lower-stage housings have not been properly combined together.

In the invention, the lock piece portion is passed through the passage groove in the upper-stage housing, and is inserted into the insertion groove in the lower-stage housing, and at this time if the lock piece portion, passed through the passage groove, cannot be inserted into the insertion groove, it can be easily conformed form this that the upper-stage housing and the lower-stage housing are not properly combined together. If the lock piece portion, passed through the passage groove, can be inserted into the insertion groove, it can be easily confirmed from this that the upper-stage housing and the lower-stage housing are properly combined together.

In this invention, the lock piece portion serves as a reinforcement member, thereby increasing the strength of the connector assembly.

In the invention, when the upper-stage housing and the lower-stage housing are completely combined together, the upper-stage housing closes the terminal receiving grooves in the lower-stage housing, and the two hood walls are combined together to form the hood portion for receiving the mating connector, and therefore even when a force is applied from the mating connector to one hood wall, the strength of combination will not be affected.

In the invention, by press-fitting the wire end into the wire connection portion of the terminal received in the wire receiving groove, the wire end is inserted in between the press-connecting blades, thereby easily making a connection between the wire and the terminal.

What is claimed is:

1. A connector assembly which is engageable with and can be fixed to a mounting portion of a vehicle body, comprising:

a plurality of housings which can be stacked and combined together in a multi-stage manner;

a plurality of terminals respectively insertable into the housings, the terminals each having a contact portion for mating with another terminal and a wire connection portion for connection to an end of a wire; and a fitting mechanism allowable the engagement and fixing of the connector assembly relative to the mounting portion when the housings are in a completely-combined condition in which the housings are properly combined, and preventing the engagement and fixing of the connector assembly relative to the mounting portion when the housings are in an incompletely-combined condition in which the housings are improperly combined.

2. A connector assembly according to claim 1, in which the housings include an upper housing and a lower housing, the fitting mechanism includes a passage groove through which a plate-like lock piece portion of the mounting portion is passable formed in the upper housing, and an insertion groove formed in the lower housing, the insertion groove into which the lock piece portion passed through the passage groove in the completely-combined condition are insertable, and the insertion groove fails to receive the lock piece portion passed through the passage groove in the incompletely-combined condition.

3. A connector assembly according to claim 2, in which the housings each includes a terminal receiving groove into which one of the terminals is insertable, the upper housing includes a cover openable and closable the terminal receiving groove, and a hood wall formed integrally at that portion of the upper housing opposite to the terminal receiving groove, the lower housing includes a hood wall which is formed integrally at that portion of the lower housing opposite to the terminal receiving groove and covers the contact portions of the terminals, the passage groove is formed in the upper housing, and the insertion groove is formed in the hood wall of the lower housing, and wherein when the housings are completely combined together, the passage groove and the insertion groove jointly form an engagement groove in which the lock piece portion can be inserted and engaged.

4. A connector assembly according to claim 3, in which when the housings are completely combined together, the upper housing closes the terminal receiving groove in the lower housing, and the two hood walls are completely combined together to form a hood portion for receiving a mating connector.

5. A connector assembly according to claim 1, in which each of the terminals is a press-connecting terminal having a press-connecting portion formed at the wire connection portion, and the press-connecting portion has a pair of press-connecting blades between which the wire end is press-connected.

* * * * *